US007950196B1

(12) United States Patent
Sorkin

(10) Patent No.: US 7,950,196 B1
(45) Date of Patent: May 31, 2011

(54) SEALING TRUMPET FOR A POST-TENSION ANCHORAGE SYSTEM

(76) Inventor: Felix L. Sorkin, Stafford, TX (US)

( * ) Notice: Subject to any disclaimer, the term of this patent is extended or adjusted under 35 U.S.C. 154(b) by 321 days.

(21) Appl. No.: 11/874,078

(22) Filed: Oct. 17, 2007

Related U.S. Application Data

(63) Continuation-in-part of application No. 11/861,185, filed on Sep. 25, 2007, now Pat. No. 7,841,140.

(51) Int. Cl.
*E04C 5/08* (2006.01)

(52) U.S. Cl. ..... 52/223.13; 403/314; 403/367; 403/369; 403/374.1

(58) Field of Classification Search ..... 52/223.13; 403/365, 367, 368, 369, 374.1, 304, 314; 24/122.6, 122.3, 459, 136 R, 115 M
See application file for complete search history.

(56) References Cited

U.S. PATENT DOCUMENTS

| | | | | | |
|---|---|---|---|---|---|
| 274,796 | A | * | 3/1883 | Loehner | 403/314 |
| 833,548 | A | * | 10/1906 | Putnam | 403/368 |
| 1,646,660 | A | * | 10/1927 | Prince | 439/805 |
| 2,166,458 | A | * | 7/1939 | Berndt et al. | 439/788 |
| 3,534,989 | A | * | 10/1970 | Yonkers | 403/369 |
| 3,596,330 | A | * | 8/1971 | Scott et al. | 24/122.3 |
| 3,698,749 | A | * | 10/1972 | Yonkers | 403/197 |
| 4,494,890 | A | * | 1/1985 | Lusk | 403/267 |
| 4,619,088 | A | * | 10/1986 | Ripoll Garcia-Mansilla | 52/223.13 |
| 5,469,677 | A | * | 11/1995 | Luthi | 52/223.13 |
| 5,630,301 | A | * | 5/1997 | Sieg | 52/223.13 |
| 5,770,286 | A | | 6/1998 | Sorkin | |
| 5,839,235 | A | | 11/1998 | Sorkin | |
| 5,897,102 | A | * | 4/1999 | Sorkin | 254/29 A |
| 6,098,356 | A | | 8/2000 | Sorkin | |
| 6,381,912 | B1 | | 5/2002 | Sorkin | |
| 6,631,596 | B1 | | 10/2003 | Sorkin | |
| 6,817,148 | B1 | | 11/2004 | Sorkin | |

* cited by examiner

*Primary Examiner* — Brian E Glessner
*Assistant Examiner* — Adriana Figueroa
(74) *Attorney, Agent, or Firm* — Egbert Law Offices PLLC

(57) ABSTRACT

An anchorage for post-tension system has an anchor body with an interior passageway, a polymeric encapsulation extending over the anchor body so as to define a trumpet extending outwardly on one side of the anchor body, and an annular seal formed so as to extend inwardly relative to a wall of the trumpet. The annular seal is in liquid-tight sealing relation with an outer surface of a tendon extending through the interior passageway. A fixing element is formed within the interior passageway so as to fix a position of the sheathing on the tendon.

3 Claims, 2 Drawing Sheets

SEALING TRUMPET FOR A POST-TENSION ANCHORAGE SYSTEM

CROSS-REFERENCE TO RELATED APPLICATIONS

The present invention is a continuation-in-part of U.S. application Ser. No. 11/861,185, filed on 25 Sep. 2007 and entitled "Apparatus for Preventing Shrinkage of a Sheathing over a Tendon", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post tension anchor systems. More particularly, the present invention the present invention relates to seals as used within polymeric encapsulated anchor bodies. More particularly, the present invention the present invention relates to apparatus used to prevent shrinkage of a sheathing that extends over a tendon.

2. Description of Related Art

Including Information Disclosed Under 37 CFR 1.97 and 37 CFR 1.98.

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation.

After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the tendon. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead end anchorage, the end of the sheathing will tend to shrink slowly away from the dead end anchorage.

The problem that affects many anchorage system is the inability to effectively prevent liquid intrusion into this area of the unsheathed portion. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. Each patent associated with this technology suggests the placement of an additional tube over the polymeric encapsulation and additional materials for sealing the unsheathed portion of the tendon which extends outwardly of the anchor. In certain circumstances, these tubes are sometimes improperly installed and, at best, are simply an additional component that needs to be associated with the post-tension system. As such, it adds additional costs and can require additional labor associated with the installation of the sealing tube. As such, a need has developed so as to avoid the use of such a tube with the dead-end anchor of a post-tension anchor system.

It is an object of the present invention to provide an anchor for a post-tension system which effectively prevents liquid intrusion into the passageway of the anchor body.

It is another object of the present invention to provide an anchorage for a post-tension system which minimizes the amount of polymeric encapsulation used over the anchor body.

It is still a further object of the present invention to provide an anchorage for a post-tension system which avoids the use of tubes, tape and other appliances for establishing an effective seal between the outer surface of the sheathing of the tendon and the interior passageway of the anchor body.

These and other objects and advantages of the present invention will become apparent from a reading of the attached specification and appended claims.

BRIEF SUMMARY OF THE INVENTION

The present invention is an anchorage for post-tension system that comprises an anchor body having an interior passageway, a polymeric encapsulation extending over the anchor body so as to define a trumpet extending outwardly on one side of the anchor body, and an annular seal formed so as to extend inwardly relative to a wall of the trumpet. The annular seal is coaxial with the interior passageway of the anchor body. This annular seal is positioned adjacent the one side of the anchor body.

A tendon extends through the interior passageway of the anchor body. The annular seal is in liquid-tight sealing relationship with an outer surface of the tendon. In particular, the tendon has a sheathed portion and an unsheathed portion. The annular seal is in liquid-tight sealing relationship with the sheathed portion of the tendon.

In the present invention, a fixing means is positioned in the interior of the passageway of the anchor body for fixing a position of the sheathing on the tendon.

The trumpet has a length of no more than two inches in the preferred embodiment of the present invention. The annular seal is positioned inwardly of an end of the trumpet opposite the anchor body. In the preferred embodiment of the present invention, the annular seal is integral with the trumpet. This polymeric encapsulation is in liquid-tight sealing relationship with an exterior surface of the anchor body.

The present invention is also an anchorage for post-tension system that comprises a tendon having a sheathed portion and an unsheathed portion, an anchor body having an interior passageway extending therethrough, a pair of wedges engaged with the unsheathed portion of the tendon within the interior passageway, a polymeric encapsulation extending over the anchor body so as to define a trumpet extending outwardly on one side of the anchor body, and an annular seal interposed in liquid-tight sealing relationship between the sheathing portion of the tendon and an inner wall of the trumpet. A fixing means is engaged with the sheathed portion for fixing a position of the sheathing on the tendon. The fixing means is positioned between the pair of wedges and the annular seal. At least one wedge member is positioned at an end of the pair of wedges and interposed between the sheathing and the tendon so as to frictionally engage the sheathing.

DETAILED DESCRIPTION OF THE INVENTION

Figure 1:
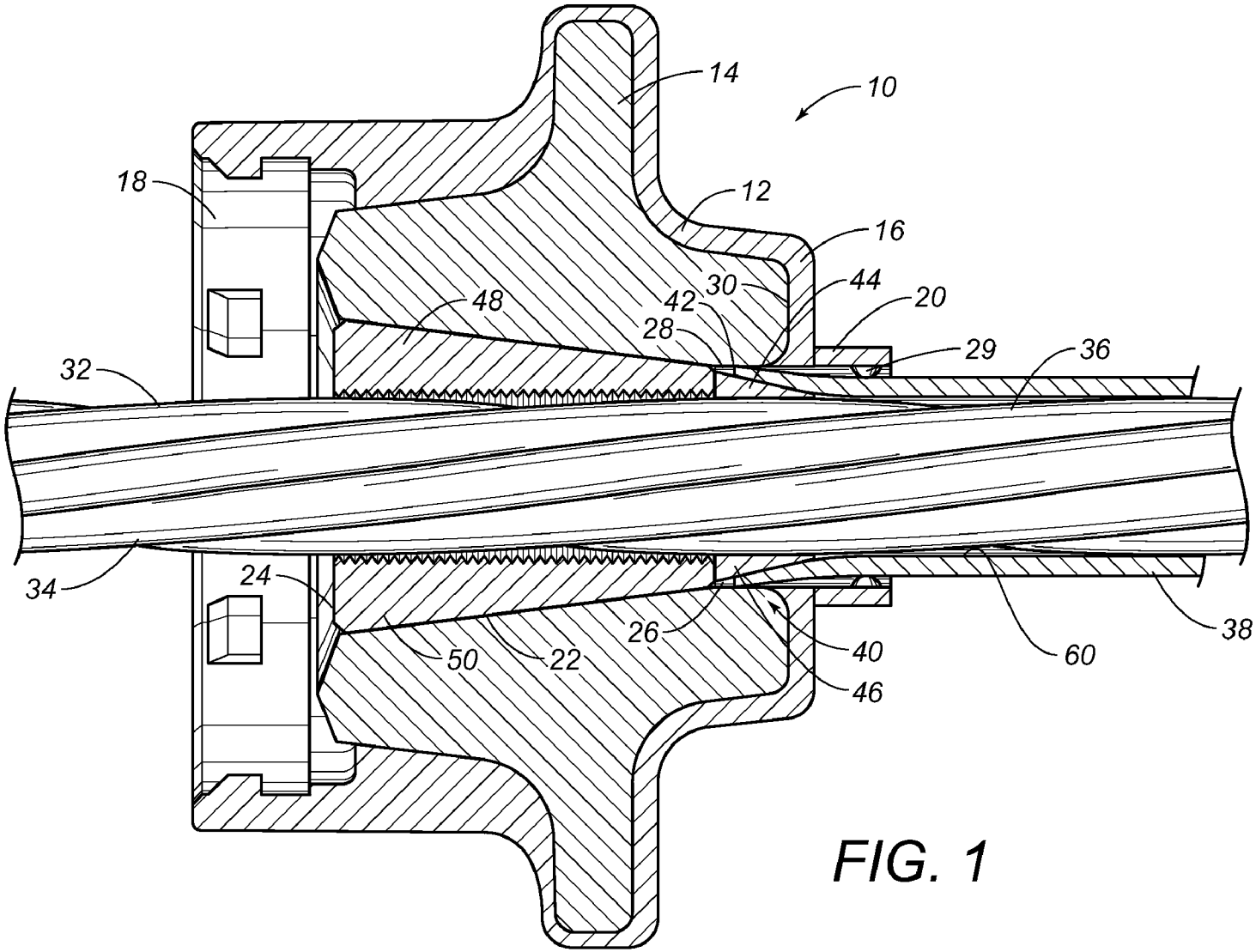
FIG. 1 is a cross-sectional view of the anchorage system of the preferred embodiment of the present invention.

Referring to FIG. 1, there is shown the apparatus 10 for resisting the shrinkage of a sheathing of a tendon in a post-tension anchor system. In particular, the apparatus 10 shows the dead-end anchorage 12. The dead-end anchorage 12 includes an anchor member 14 with a polymeric encapsulation 16 extending thereover and therearound. A cap-receiving opening 18 is formed at one end of the polymeric encapsulation 16. A trumpet 20 is formed at the opposite end of the polymeric encapsulation 16. The trumpet 20 is a tubular section that extends outwardly of the end of the dead-end anchorage 12 for a short distance. The anchor member 14 is a steel anchor. The anchor member 14 has a cavity 22 formed in an interior thereof. The cavity 22 has tapered walls having a wide end 24 and a narrow end 26. The wide end 24 opens at an end of the anchor member 14. The narrow end 26 opens on the interior of the cavity 22. A passageway 28 extends from the narrow end 26 of cavity 22 to the opposite end 30 of the anchor member 14. An annular seal 29 is formed on an inner wall of the trumpet 20. The annular seal 29 is coaxial with the passageway 28.

As can be seen in FIG. 1, the trumpet 20 extends for only a small distance from the end of the anchor member 14. In the preferred embodiment of the present invention, trumpet 20 has a length of less than two inches. The annular seal 29 is generally positioned adjacent to the end 30 of anchor member 14 and is formed on the inner wall of the trumpet 20. In the preferred embodiment of the present invention, this annular seal 29 is arranged so as to prevent liquid intrusion into the passageway 28 of anchor body 14. In the preferred embodiment of the present invention, the annular seal 29 is integrally formed with the trumpet 20. However, and alternatively, the annular seal 29 can be of a different elastomeric material than the material of the trumpet 20. When the annular seal 29 is formed of such an elastomeric material, or formed of a material that is different than that of the polymeric encapsulation 16, it can be affixed in position against the inner wall of the trumpet 20 by a variety of techniques.

A tendon 32 extends entirely through the cavity 22 of the anchor member 14. The tendon 32 also extends through the trumpet 20 of the polymeric encapsulation 16. The tendon 32 has an unsheathed portion 34 and a sheathed portion 36. Sheathing 38 extends over the tendon 32. Typically, a lubricant will be applied between the exterior surface of the tendon 32 and the inner surface 60 of the sheathing 38.

In the present invention, a fixing means 40 is positioned in the passageway 28 of cavity 22. The fixing means 40 serves to engage with the end 42 of the sheathing 38 so as to strongly adhere to the end 42 of the sheathing 38 within the passageway 28.

As can be seen in FIG. 1, the fixing means 40 includes a pair of wedge members 44 and 46 that will be interposed between the end 42 of the sheathing 38 and the surface of the tendon 32. Each of wedge members 44 and 46 generally abuts the ends of the wedges 48 and 50, respectively, extending within the cavity 22. Each of the wedge members 44 and 46 exerts a force on the end 42 of the sheathing 38 which causes the end 42 of the sheathing 38 to be rigidly retained in frictional relationship between inner wall of the passageway 28 and the outer surface of the wedge members 44 and 46. As such, the end 42 of the sheathing 38 is fixedly retained within the passageway 28. Because of this fixed retention, any shrinkage effects are avoided at the dead-end anchorage 12 of apparatus 10.

This frictional engagement is extremely effective in preventing the shrinkage of the sheathing 38. Typically, the force of shrinkage is between 100 and 150 pounds of pulling force. On the other hand, the force of the wedges 48 and 50, as installed, will resist 30,000 pounds of force applied to the tendon 32. As such, although the frictional engagement of the end 42 of sheathing 38 with the wall of the passageway 28 would appear to be rather weak, the forces are actually very strong as compared to those that are required in order to keep the sheathing 38 from shrinking.

The trumpet 20 includes the annular seal 29 extending around an interior thereof. The annular seal 29 will be in liquid-tight engagement with a surface of the sheathing 38. As such, the seal 29 effectively prevents liquid intrusion into the interior cavity 22 of the anchor body 14. The present invention, in this manner, effectively avoids the use of any sealing tubes that are affixed over, under or around the trumpet 20 of the encapsulation 16. The short length of the trumpet 20 serves to minimize the amount of material that is used for the polymeric encapsulation 16. An effective liquid-tight seal is formed between the annular seal 29 and the sheathing 38. Another effective liquid-tight seal is formed by the frictional engagement of the end of the sheathing 38 with the wall of passageway 28 by way of fixing means 40. As such, the configuration of the present invention not only avoids the use of tubes, tape, and other additional accessories, that also enhances the ability to seal the interior passageway 28 from liquid intrusion. The minimal length of the trumpet 20 further enhances the ability to easily "thread" the passageway over the tendon 32.

Figure 2:
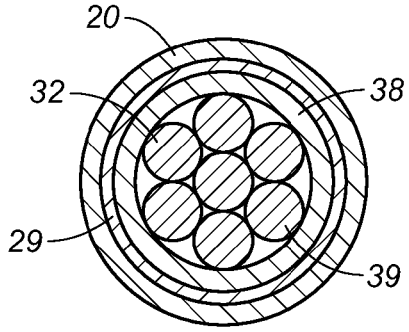
FIG. 2 is a cross-sectional view taken across lines 2-2 of FIG. 1.

FIG. 2 illustrates a cross-sectional view as taken across lines 2-2 of FIG. 1. In particular, it can be seen that the tendon 32 has wire bundles 39 extending through the interior thereof. Sheathing 38 extends over the wire bundles 39 on the interior of the tendon 32. The annular seal 29 is illustrated in liquid-tight sealing relationship over the exterior surface of sheathing 38. The annular seal 29 extends around the interior wall of the trumpet 20. As can be seen in FIG. 2, there is a very tight liquid-tight seal between the exterior surface of the sheathing 38 and the inner wall of the trumpet 20.

Figure 3:
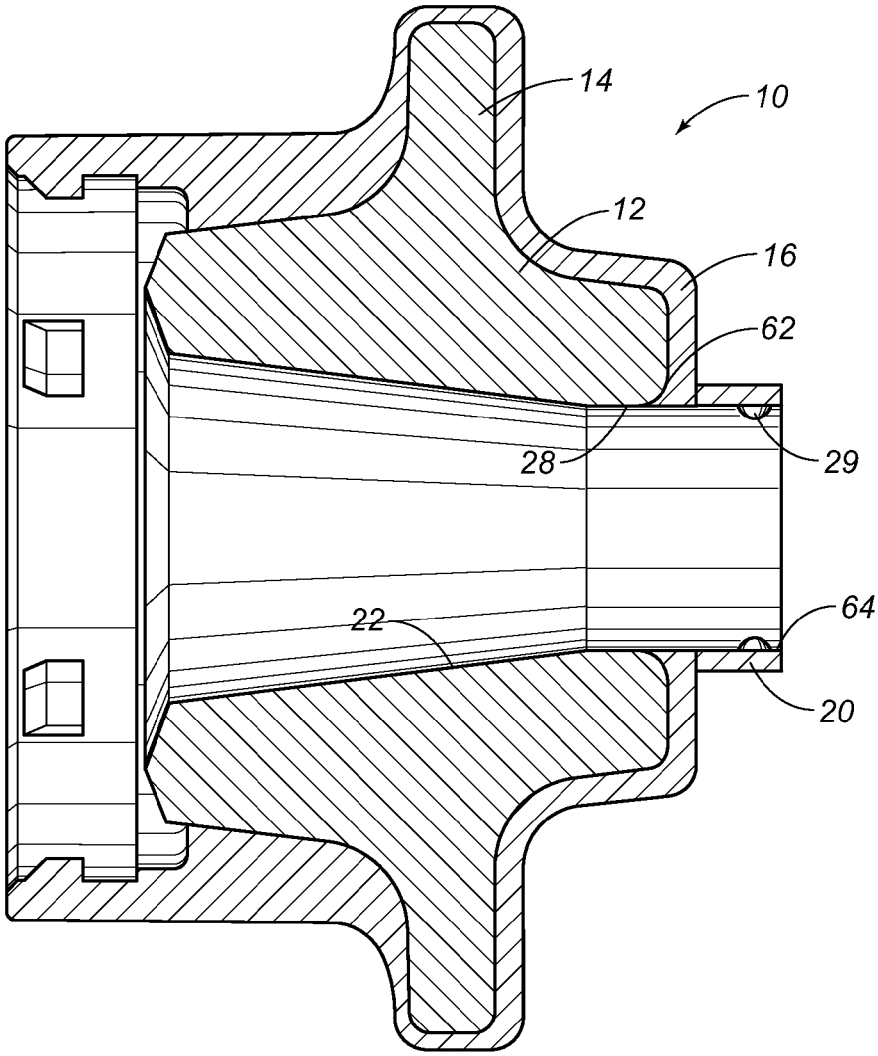
FIG. 3 is a cross-sectional view of the anchorage of the preferred embodiment of the present invention without the tendon and wedges extending therethrough.

FIG. 3 show an isolated view of the anchorage 12. The anchorage 12 includes the anchor member 14 that is formed of a steel material. The polymeric encapsulation 16 is formed in an injection-molding process so as to be in strong liquid-tight surface-to-surface relationship with the exterior surface of the anchor member 14. The interior of the anchor member 14 defines the cavity 22 and passageway 28. The cavity 22 is tapered to receive wedges 48 and 50 therein. The passageway 28 has a generally constant diameter that curves outwardly at end 62.

The polymeric encapsulation 16 defines the trumpet 20 at one side of the anchor member 14. The annular seal 29 is formed on the inner wall 64 of trumpet 20 and extends inwardly therefrom for a short distance. The annular seal 29 should have an inner diameter which is slightly smaller than the outer diameter of the sheathing 38 of tendon 32. As such, when the tendon 32 is installed through the cavity 22 and passageway 28, the annular seal 29 will suitably compress so as to be in liquid-tight sealing relationship with the outer surface of the sheathing 38.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An anchorage for a post-tension system comprising:

a tendon having a sheathed portion and an unsheathed portion;

an anchor body having an interior passageway with a wall extending therearound;

a pair of wedges engaged with said unsheathed portion of said tendon within said interior passageway;

a polymeric encapsulation extending over said anchor body, said polymeric encapsulation defining a trumpet extending outwardly on one side of said anchor body, said trumpet having a length of no more than two inches;

an annular seal interposed in liquid-tight sealing relation between said sheathed portion of said tendon and an inner wall of said trumpet, said annular seal positioned inwardly of an end of said trumpet opposite said anchor body, said annular seal being integral with said trumpet and formed of a material identical to a material of said trumpet; and at least one wedge member abutting an end of said pair of wedges, the wedge member having a portion residing against said unsheathed portion and another portion urging against said sheathed portion so as to fix an end of said sheathed portion against said wall of said interior passageway of said anchor body.

2. The anchorage assembly of claim 1, said polymeric encapsulation being in liquid-tight sealing relation with an exterior surface of said anchor body.

3. The anchorage assembly of claim 1, said annular seal being coaxial with said interior passageway of said anchor body, said annular seal positioned adjacent said one side of said anchor body.

* * * * *